US005295929A

United States Patent [19]

Weisz

[11] Patent Number: 5,295,929

[45] Date of Patent: Mar. 22, 1994

[54] HYDROTHERAPY DEVICE WITH UNDERWATER TREADMILL

[76] Inventor: Stefano Weisz, Via Gagliardi, 14/a, I-31021, Mogliano Veneto, Italy

[21] Appl. No.: 793,386

[22] PCT Filed: Jul. 12, 1990

[86] PCT No.: PCT/EP90/01134

§ 371 Date: Jan. 15, 1992

§ 102(e) Date: Jan. 15, 1992

[87] PCT Pub. No.: WO91/01162

PCT Pub. Date: Feb. 7, 1991

[30] Foreign Application Priority Data

Jul. 18, 1989 [IT] Italy ..... 84142 A/89

[51] Int. Cl.[5] ..... A63B 21/00

[52] U.S. Cl. ..... 462/54; 462/111; 462/908; 4/495

[58] Field of Search ..... 482/54, 111, 4, 55; 119/29; 4/507, 495

[56] References Cited

U.S. PATENT DOCUMENTS

| | | | |
|---|---|---|---|
| 3,485,213 | 12/1969 | Scanlon | 119/29 |
| 3,553,743 | 1/1971 | Lodige | 4/495 |
| 3,598,088 | 8/1971 | Bowman | 119/29 X |
| 3,935,600 | 2/1976 | Scribner | 4/495 |
| 4,271,542 | 6/1981 | Wood et al. | 4/495 |
| 4,332,217 | 6/1982 | Davis | 119/29 |
| 4,419,776 | 12/1983 | Schmidt | 4/495 X |
| 4,574,739 | 3/1986 | Fontaine et al. | 119/29 |
| 4,576,376 | 3/1986 | Miller . | |
| 4,712,788 | 12/1987 | Gaudreau, Jr. | 482/54 |
| 4,776,581 | 10/1988 | Shepherdson | 482/54 X |

FOREIGN PATENT DOCUMENTS

| | | |
|---|---|---|
| 0002188 | 10/1978 | European Pat. Off. . |
| 103263 | 3/1984 | European Pat. Off. . |
| 8806049 | 8/1988 | PCT Int'l Appl. . |
| 2200548 | 8/1988 | United Kingdom . |

OTHER PUBLICATIONS

The Aquaciser Catalog (1987).

*Primary Examiner*—Richard J. Apley
*Assistant Examiner*—Beverly A. Meindl
*Attorney, Agent, or Firm*—Hoffman, Wasson & Gitler

[57] ABSTRACT

Hydrotherapic rehabilitative device characterized in that it comprises an individual rehabilitation horizontal tub (6), whose bottom is partially formed by a vertically movable treadmill platform (9) and whose walls extend downwardly beyond said bottom to delimit a space (7) containing a pool of water and receiving a patient standing on said treadmill platform, when lowered 13 Claims, 1 Drawing Sheet

HYDROTHERAPY DEVICE WITH UNDERWATER TREADMILL

The present invention relates to a hydrotherapic rehabilitation device.

Hydrotherapy is widely adopted in the field of physical medicine, in that it constitutes one of the fundamental pillars of the treatment and rehabilitation of patients suffering from various rheumatic disorders, whether inflammatory or degenerative, as well as from many physical traumas (e.g. fractures, sprains, or a sequence of these). In fact, it is commonly known that water, be it from mineral springs or of marine or thermal origin, performs an anti-contractural, anti-inflammatory and sedative function, by virtue of its important physicochemical properties: it is an excellent solvent and a good heat accumulator, and its density is such that the influence of gravity can be remarkably reduced and adjusted, which is of great importance to achieve specific therapeutic purposes; for instance, water has advantageous therapeutic applications in the case of patients needing rehabilitation as a result of lower limb injuries (after-effects of surgically or bloodlessly treated fractures, after-effects of artificial hip or knee operations, reconstitution of ligaments or their substitution for artificial ligaments, meniscectomy, paraplegia or hemiplegia, etc.), as well as in the case of patients affected simply by malformations and degenerative or inflammatory pathologies of the lower limbs (arthrosis, rheumatic arthritis).

Generally a rehabilitative therapeutic cycle has to be carried out gradually, so that the weight on the various segments of the body (feet, legs, hips, low back) doesn't causes excessive stresses. In particular a rehabilitative therapeutic cycle foresees a first period of rehabilitation in clinostatic condition (the patient carries out his exercises being fully lain down and moves his articulations without loading the skeletal apparatus), subsequently, when advisable, in seated condition (the patient is seated and moves the legs, knees and feet, overcoming the resistance of the water), and finally in orthostatic condition (the patient stands on feet) grading the weight on the several parts of his body so that the skeletal apparatus is stressed with the necessary graduality.

The traditional technique foresees that the rehabilitation in clinostatic conditions occurs in traditional tubs, into which the patient is immersed in horizontal condition, aided by a physiotherapist, who from outside helps him during the rehabilitative exercises. To carry out the rehabilitation in orthostatic conditions the patient must be transferred into an other tub, more deep, in which he can be subjected to a "lightened" weight. This tub consists of a traditional pool in which the patient is immersed together with the physiotherapist, who helps him to carry out exercises.

However these pools present considerable disadvantages, and in particular:

- very great costs of installation and maintenance, with the result that only very few hospitals can afford them;
- an enormous bulk, which very often deprives other equally important services of plenty of space;
- the necessity of employing a numerous staff to treat and look after the patients;
- frequent problems with the staff, obliged to enter the water with the patients;

- the need to use the same pool for several patients at a time, with the consequent inability to offer each of them a personalised, and therefore more effective treatment;
- the difficulty in monitoring hygienic conditions and the consequent need to use water sterilizing substances in high proportions, which might cause allergic reactions or intolerances to these substances in many patients;
- high running costs, due to heating, water recycling and attending staff;
- the need for patients undergoing rehabilitation training to be hospitalized for quite long periods of time.

These drawbacks have considerably hindered the spread of hydrotherapy as carried out in pools, and accordingly restricted the opportunity to resort to early and very early ambulation as a treatment of many lower limb pathologies, with all the disastrous consequences that this situation inevitably produces.

From U.S. Pat. No. 4 574 739 a horse exercising device is already known, comprising a rectangular tank for holding a pool of water and a treadmill vertically adjustable according to the reduction of weight desired for the horse. This device is very useful for providing a variable exercise program to control exertion of the horse, but cannot be advantageously used for humans, as it does not allow to carry out a complete rehabilitative therapeutic program for a patient, i.e. a program comprising a first period of rehabilitation in clinostatic conditions, subsequent period in the same tub in seated conditions and a final period in orthostatic conditions, with gradual increase of weight on the several parts of his body.

Also GB-A-2 200 548 discloses an exercising and massaging device for humans, horses and other animals. It is similar to the precedent one and cannot be used for a complete rehabilitation therapeutic program.

According to the invention the problem is solved by means of a hydrotherapic rehabilitative device characterized in that it comprises an individual rehabilitation horizontal tub, whose bottom is partially formed by a vertically movable treadmill platform and whose walls extend downwardly beyond said bottom to delimit a space containing a pool of water and receiving a patient standing on said treadmill platform, when lowered.

The present invention is hereinafter further clarified with reference to the enclosed sheets of drawings, in which.

Figure 1:
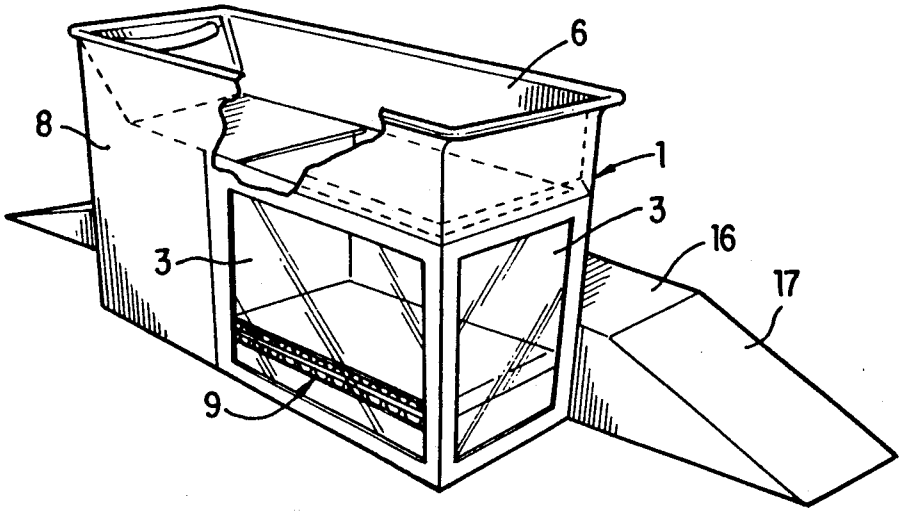
FIG. 1 shows in perspective general view a device according to the invention.

As shown in the drawings, the device according to the invention includes a tub 1, the dimensions of which must be suitable to hold a patient 2 in the erect position. The tub 1 could, for instance, be 160 cm high, 180 cm long and 80 cm wide. It should preferably be made of metallic or plastic material, with two transparent (e.g. glass or plexiglass) walls 3. It will be horizontally divided into two parts: an upper part 6, basically constituting a traditional tub for individual rehabilitation, which is designed to hold the patient 2 in the clinostatic (horizontal) position, and a lower part 7, which is meant to hold the patient 2 in the orthostatic (erect) position once the two parts of the tub have been made intercommunicating.

Since the space taken up by the patient is smaller when he is standing than when he is lying, a portion of the lower part 7 of the tub 1 will be used as a container 8 for the apparatus needed to operate the device.

Along a side of the tub 1 a footboard 16 is foreseen, equipped with a chute 17 to let a stretcher-trolley going uphill, thus allowing a non walking patient 2 to be easily transferred into the tub 6. Under the footboard 16 there are water treatment and recycling reservoirs 18, equipped with pumps (not shown) for the rapid intake and drainage of water, irrespective of waterworks.

The tub 1 is provided with a traditional pipe 4 for the drainage of water, and is connected to a pipe 5 fitted to the surge tank, for the intake of more water.

Figure 2:
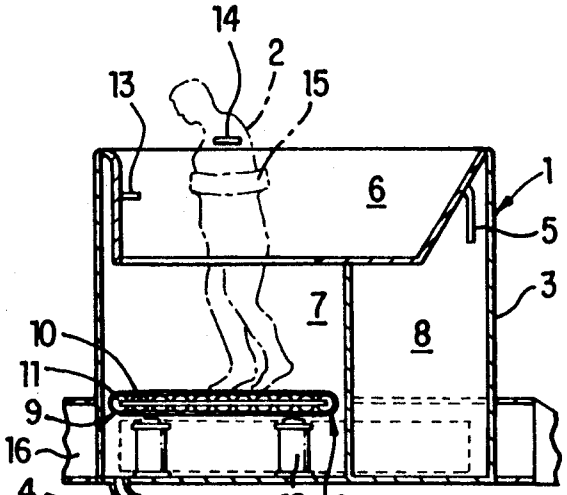
FIG. 2 shows it in side view and with the treadmill platform in lowered condition.
Figure 3:
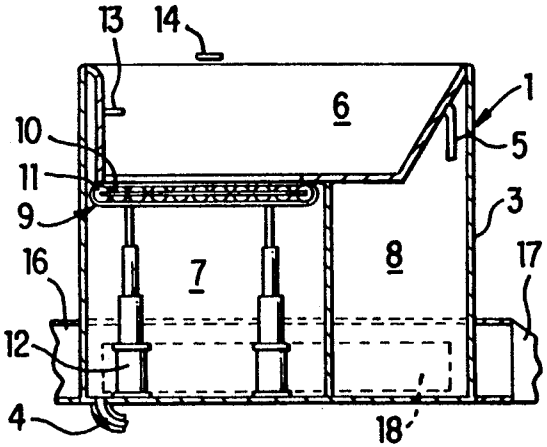
FIG. 3 shows it in the same view and with the treadmill platform in raised condition.

The division between the upper part 6 and the lower part 7 of the tub 1, i.e. the bottom of the tub 6, consists for the most part of a treadmill platform 9 comprising a continuous rubber mat supported by a roller frame 10 which can be moved vertically, from an upper position (see FIG. 3) in which it really constitutes the bottom of the upper part 6 of the tub 1, to a lower position (see FIG. 2), in which it is located near the bottom of the tub itself.

The rollers 11 of the treadmill platform 9 can be either idle or motor-driven, depending on the circumstances. In the latter case, the starter (not shown) of at least one roller should preferably be operated by air and equipped with a drive having adjustable speed and/or acceleration and/or direction of movement.

The frame 10 supporting the rollers 11 is designed in such a way that it can be tilted lengthways and raised by means of ordinary pneumatic pistons 12 or other suitable mechanical devices.

The tub is also provided with a number of devices to support the patient 2 during the treatment, i.e. handles 13, armpit rests 14 and safety belts 15. Safety belts, in particular, should be inflatable, in order to make it possible to modify the patient's weight and, as a consequence, the load applied to his lower limbs, according to the amount of inflated air.

As far as the hydraulic system is concerned, the tub 1 can be equipped both with a recycling system, to provide hydromassage and water heating and sterilization, and with small openings for the intake of compressed air, ozone and disinfectant or sterilizing substances.

The device also includes various adjusting and checking devices, particularly as regards the speed of the treadmill platform 9, if it is motor-driven, and the operational parameters, i.e. the temperature, level and degree of ozonization of the water, the amount of air and/or water to be used for hydromassage, the load on the treadmill platform, and so forth.

The device operates as follows: first of all, the patient 2, transferred by means of a stretcher-trolley on the footboard 16, is transferred into the tub 1 filled with water after the treadmill platform 9 has been raised to form the bottom of the upper part, so that this constitutes an ordinary hydrogalvanic rehabilitation tub or whirlpool bath.

In this condition (full length but with the head supported out the water), the patient can carry out his exercises aided by the physiotherapist, who remains at the outside of the tub. When the physiotherapist considers that it is the time to begin the rehabilitative therapy in more exacting conditions, he causes the lowering of the treadmill platform, which also constitutes part of the bottom of the tub. As the upper tub 6 is substantially a traditional rehabilitation tub, and like this it has the bottom extending to an inclined portion, which obviously does not follow the bottom during its lowering, this inclined portion can form a kind of seat, on which the patient can seat to carry out the exercises for the legs, knees and feet immersed in water.

Subsequently the physiotherapist causes further lowering of the treadmill platform 9, in such a way that the patient 2, who can meanwhile be supported by the armpit rests 14, handles 13 or safety belt 15, stands on said platform 9, passing to the erect position without coming out of water: he is therefore subjected to an upward buoyant force, the magnitude of which is equal to his level of immersion in the water.

Clearly, this buoyant lift can be predetermined and even freely modified, either by gradually inflating or deflating the safety belt 15, or by changing the level of immersion of the body in the water, which is done by modifying the water level or the position of the mat 9. Once the patient 2 has been immersed in the water and the desired magnitude of the buoyant force has been reached, he is asked to walk on the treadmill platform 9; if this is mounted on idle rollers 11, its backward movement will be obtained simply by virtue of the lower limb thrust (active rehabilitation), and the patient will not move with respect to the tub 1 since he will lean on the handles 13 or be supported by other devices; conversely, if the treadmill platform 9 is mounted on motor-driven rollers, the patient 2 will have to diversify the rhythm of his movements so as to maintain his position unchanged with respect to the tub 1 (passive rehabilitation).

For some of its possible applications, the treadmill platform 9 can be tilted, so as to simulate the conditions of walking on an inclined plane.

All checks and adjustments can be made either manually (on the basis of previously drawn-up tables) or automatically (preferably by using a computer), so as to take carefully into consideration all the parameters involved in the hydrotherapy training and modify them, if necessary, in order to meet specific requirements.

Substantially the device according to the invention utilizes a treadmill platform, but differently from the traditional devices utilizes this treadmill platform for several functions, and in particular, besides than the typical function of treadmill platform to allow the patient to walk, also the function to form the bottom of a traditional tub, in which the patient can be submitted to a rehabilitative therapy in horizontal conditions, as well as the function of supporting member for the patient during the passage from the horizontal to the vertical condition, thus allowing the physiotherapist to aid the patient during any step of the rehabilitative therapy, without ever removing him from the tub, and thank to this feature, to subject the patient in a reduced space to a complete rehabilitative therapy cycle which can be easily modified according to the requirements of the therapy.

Furthermore, thank to the unicity of the tub for the rehabilitation, to be used both in clinostatic and orthostatic condition, it is possible to determine, from the difference between the weight (known) of the patient, and the weight of the displaced water (which can be read on a graduated scale from the level change of the water after the patient has been immersed) the real load which stresses the lower limbs, and to determine if this load is admissible or must be further lightened, for example with the aid of floating belts or other support means.

This determination doesn't require any further operations, since it occurs during the normal step of the rehabilitation hydrotherapic cycle.

For all these reasons the device according to the invention can be advantageously utilized in all the cases, in which a hydrotherapic rehabilitation is required, and in particular in the fields of:

rheumatology;

vascular surgery, notably phlebology (venous insufficiences, stasis edemas, varicous and postphlebitic ulcers, etc.);

cardiology;

aesthetic medicine and surgery (adjuvant treatment of cellulitis, after-effects of liposuction operations, etc.);

dermatology (various cutaneous diseases which benefit from ozone treatment and hydromassage);

pregnancy;

geriatrics and internal medicine as a whole, as regards the rehabilitation of patients who have been confined to bed for long periods of time or who suffer from after-effects of hemiparesis or neurological injuries in general, etc.;

rehabilitation of the physically disabled patients;

muscular strengthening in some sports.

Yet, the most important application of the device according to the invention is in the field of orthopaedics and traumatology, with specific regard to the treatment of patients:

suffering from after-effects of both bloodlessly and surgically treated traumatisms (fractures, dislocations, sprains, etc.);

having artificial joints (hip, knee, ankle) or ligaments (knee, ankle) on;

treated with osteoctomy owing to hip or knee arthrosis;

suffering from various malformations (congenital dysplasia, clubfoot, flatfoot or hollow foot), as well as from degenerative pathologies which require long loadlessness periods (e.g. adolescent's hip osteochondritis) and, as a consequence, very long rehabilitation periods.

I claim:

1. A multifunction rehabilitative hydrotherapeutic device comprising a watertight container, having an upper part and a lower part, provided with an endless belt vertically adjustable between a upper position in which said endless belt forms a part of a bottom of a horizontal tub, located in said upper part of said container for clinostatic rehabilitation of a person, and a lower position in which said endless belt forms a walking treadmill platform, located in said lower part of said container, for a person housed upright inside said container for orthostatic rehabilitation.

2. A multifunction rehabilitative device according to claim 1, wherein at least one wall of said container is made of transparent material.

3. A multifunction rehabilitative device according to claim 1, wherein said device further comprises a water-recycling system.

4. A multifunction rehabilitative device according to claim 1, wherein said device further comprises water and/or compressed gas intake openings.

5. A multifunction rehabilitative device according to claim 1, wherein said walls of said container further comprises a backing and/or supporting means for the person walking on the treadmill platform.

6. A multifunction rehabilitative device according to claim 1, wherein said treadmill platform comprises a continuous rubber mat supported by rollers mounted on a rigid frame.

7. A multifunction rehabilitative device according to claim 6, wherein said rollers are idle with respect to the rigid frame.

8. A multifunction rehabilitative device according to claim 6, wherein at least one of said rollers is motor-driven and has speed and/or acceleration and/or direction of movement which are adjustable.

9. A multifunction rehabilitative device according to claim 6, wherein said rigid frame is tilted lengthwise with respect to the bottom of said container.

10. A multifunction rehabilitative device according to claim 1, wherein said device further comprises a number of devices for the check and adjustment of various operational parameters.

11. A multifunction rehabilitative device according to claim 1, wherein a footboard and a chute are located beside said container for a stretcher-trolley, wherein said footboard is provided with at least a water treatment and recycling reservoir.

12. A multifunction rehabilitative device according to claim 11, further comprising a system of pumps for the rapid intake and drainage of water, located between said container and said reservoir.

13. A multifunction rehabilitative device according to claim 6, wherein said endless belt can be raised or lowered to an intermediate medium located between said upper and lower positions to construct seated rehabilitation therapy.

* * * * *